US010720104B2

(12) United States Patent
Gao et al.

(10) Patent No.: US 10,720,104 B2
(45) Date of Patent: Jul. 21, 2020

(54) PIXEL CIRCUIT, DISPLAY DEVICE AND DRIVING METHOD FOR PIXEL CIRCUIT

(71) Applicant: BOE TECHNOLOGY GROUP CO., LTD., Beijing (CN)

(72) Inventors: Xueling Gao, Beijing (CN); Cheng Chung Yang, Beijing (CN); Kuanjun Peng, Beijing (CN); Xiangxiang Zou, Beijing (CN); Yang Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 138 days.

(21) Appl. No.: 15/977,450

(22) Filed: May 11, 2018

(65) Prior Publication Data

US 2019/0130833 A1 May 2, 2019

(30) Foreign Application Priority Data

Sep. 7, 2017 (CN) ..... 2017 1 0800077

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3266; G09G 3/3291; G09G 2300/0426;
(Continued)

(56) References Cited

U.S. PATENT DOCUMENTS 9,892,681 B2 2/2018 Matsueda et al.
2017/0186372 A1 6/2017 Yanase et al.
(Continued)

FOREIGN PATENT DOCUMENTS

CN 105513539 A 4/2016
CN 106531076 A 3/2017
(Continued)

OTHER PUBLICATIONS

First Chinese Office Action dated Dec. 24, 2018.
Second Chinese Office Action dated Jun. 19, 2019.

*Primary Examiner* — Wing H Chow
(74) *Attorney, Agent, or Firm* — Dilworth & Barrese, LLP.; Michael J. Musella, Esq.

(57) ABSTRACT

A pixel circuit and a driving method thereof, and a display device. The pixel circuit includes a pixel unit and a bias-voltage regulating circuit. The pixel unit includes: a driving circuit configured to generate a driving current according to a control voltage at a light-emitting stage; a light-emitting control circuit configured to output the driving current to drive the light-emitting device to emit light at the light-emitting stage; a data writing circuit configured to write a data voltage into the driving circuit; a reset circuit configured to reset the driving circuit under control of a reset voltage, and to reset the light-emitting device under control of a gate line; and a bias-voltage regulating circuit configured to, before the data writing circuit writes the data voltage into the driving circuit, perform bias voltage regulation on the driving circuit to control the pixel unit to be in a bias voltage state.

20 Claims, 7 Drawing Sheets

(51) Int. Cl.
*G09G 3/3291* (2016.01)
*G09G 3/3266* (2016.01)

(52) U.S. Cl.
CPC ... *G09G 3/3291* (2013.01); *G09G 2300/0426* (2013.01); *G09G 2300/0819* (2013.01); *G09G 2300/0842* (2013.01); *G09G 2300/0861* (2013.01); *G09G 2310/0286* (2013.01); *G09G 2310/08* (2013.01); *G09G 2320/0257* (2013.01)

(58) Field of Classification Search
CPC ... G09G 2300/0819; G09G 2300/0842; G09G 2300/0861; G09G 2310/0286; G09G 2310/08; G09G 2320/0257
See application file for complete search history.

(56) References Cited

U.S. PATENT DOCUMENTS

2017/0256601 A1* 9/2017 Kim ..... H01L 27/3262
2018/0175134 A1 6/2018 Kim et al.

FOREIGN PATENT DOCUMENTS

CN 106920825 A 7/2017
CN 106940983 A 7/2017
CN 106991974 A 7/2017
CN 107068066 A 8/2017

* cited by examiner

PIXEL CIRCUIT, DISPLAY DEVICE AND DRIVING METHOD FOR PIXEL CIRCUIT

The disclosure claims the priority of the Chinese Patent Application No. 201710800077.0 filed on Sep. 7, 2017, which is incorporated herein by reference in its entirety as part of the disclosure of the present application.

TECHNICAL FIELD

Embodiments of the present disclosure relate to a pixel circuit, a display device and a driving method for a pixel circuit.

BACKGROUND

Active Matrix Organic Light Emitting Diode (AMOLED) panels are more and more widely used. A pixel display device using AMOLED is an Organic Light-Emitting Diode (OLED) display device. The AMOLED display device can emit light by driving thin film transistors to generate a driving current under a saturated state, and the driving current drives an OLED to emit light. FIG. 1 is a structural schematic diagram of a basic pixel circuit in existing technologies. As shown in FIG. 1, the existing basic pixel circuit adopts a 2T1C circuit, and the 2T1C circuit includes two thin film transistors (a switching transistor T1 and a driving transistor T2) and one storage capacitor C.

Inventor(s) found that the existing technologies at least has the following problem: due to a hysteretic lag effect of a Thin Film Transistor (TFT), a short-term afterimage phenomenon may occur when switching to different grayscale images.

SUMMARY

Embodiments of the disclosure provides a pixel circuit, comprising a pixel unit and a bias-voltage regulating circuit, wherein:

the pixel unit includes a light-emitting device, a driving circuit, a light-emitting control circuit, a data writing circuit and a reset circuit;

the driving circuit is configured to generate a driving current according to a control voltage at a light-emitting stage;

the light-emitting control circuit is configured to output the driving current to the light-emitting device at the light-emitting stage, to drive the light-emitting device to emit light;

the data writing circuit is configured to write a data voltage into the driving circuit;

the reset circuit is configured to reset the driving circuit under control of a reset voltage, and to reset the light-emitting device under control of a gate line; and the bias-voltage regulating circuit is configured to, before the data writing circuit writes the data voltage into the driving circuit, perform bias voltage regulation on the driving circuit to control the pixel unit to be in a bias voltage state.

For example, the pixel circuit comprises a plurality of pixel units, and the bias-voltage regulating circuit is configured to, before a corresponding data voltage is written into a driving circuit of each of the plurality of pixel units respectively, perform bias voltage regulation on the driving circuit of each of the plurality of pixel units, so as to control each of the plurality of pixel units to be in the same bias voltage state.

For example, the data writing circuit includes a first capacitor, a second transistor and a third transistor;

a first terminal of the first capacitor is connected to a first power source terminal and the light-emitting control circuit, and a second terminal of the first capacitor is connected to a first node;

a control electrode of the second transistor is connected to the gate line, a first electrode of the second transistor is connected to the first node, and a second electrode of the second transistor is connected to the light-emitting control circuit and the driving circuit; and a control electrode of the third transistor is connected to the gate line, a first electrode of the third transistor is connected to a data line, and a second electrode of the third transistor is connected to the light-emitting control circuit and the driving circuit.

For example, the reset circuit includes a first reset sub-circuit and a second reset sub-circuit;

the first reset sub-circuit is configured to reset the driving circuit under control of the reset voltage; and the second reset sub-circuit is configured to reset the light-emitting device under control of the gate line For example, the first reset sub-circuit includes a first transistor, and the second reset sub-circuit includes a sixth transistor;

a first electrode of the first transistor is connected to the first node, a control electrode of the first transistor is connected to a reset-voltage signal line, and a second electrode of the first transistor is connected to a first low level input terminal; and a control electrode of the sixth transistor is connected to the gate line, a first electrode of the sixth transistor is connected to a second low level input terminal, and a second electrode of the sixth transistor is connected to the light-emitting control circuit and the light-emitting device.

For example, the bias-voltage regulating circuit includes an eighth transistor, a control electrode of the eighth transistor is connected to a bias-voltage signal line, a first electrode of the eighth transistor is connected to the first node, and a second electrode of the eighth transistor is connected to the first low level input terminal.

For example, the light-emitting control circuit includes a fourth transistor and a fifth transistor;

a control electrode of the fourth transistor is connected to a third low level input terminal, a first electrode of the fourth transistor is connected to the first power source terminal and the first terminal of the first capacitor, and a second electrode of the fourth transistor is connected to the second electrode of the third transistor and the driving circuit; and a control electrode of the fifth transistor is connected to a fourth level input terminal, a first electrode of the fifth transistor is connected to a second electrode of the sixth transistor and the light-emitting device, and a second electrode of the fifth transistor is connected to the second electrode of the second transistor and the driving circuit.

For example, the fifth transistor is an N-type transistor and the fourth transistor is a P-type transistor.

For example, the fifth transistor and the fourth transistor are both P-type transistors.

For example, the driving circuit includes a driving transistor;

a control electrode of the driving transistor is connected to the first node;

a first electrode of the driving transistor is connected to the second electrode of the fourth transistor and the second electrode of the third transistor; and a second electrode of the driving transistor is connected to the second electrode of the fifth transistor and the second electrode of the second transistor.

For example, the data writing circuit includes a first capacitor, a second transistor and a third transistor;

a first terminal of the first capacitor is connected to the first power source terminal and the light-emitting control circuit, and a second terminal of the first capacitor is connected to a first node;

a control electrode of the second transistor is connected to the gate line, a first electrode of the second transistor is connected to the first node, and a second electrode of the second transistor is connected to the light-emitting control circuit and the driving circuit; and a control electrode of the third transistor is connected to the gate line, a first electrode of the third transistor is connected to a data line, and a second electrode of the third transistor is connected to the light-emitting control circuit and the driving circuit.

For example, the reset circuit includes a first reset sub-circuit and a second reset sub-circuit;

the first reset sub-circuit is configured to reset the driving circuit under control of the reset voltage; and the second reset sub-circuit is configured to reset the light-emitting device under control of the gate line.

For example, the first reset sub-circuit includes a first transistor, and the second reset sub-circuit includes a sixth transistor;

a first electrode of the first transistor is connected to the first node, a control electrode of the first transistor is connected to a reset-voltage signal line, and a second electrode of the first transistor is connected to a first low level input terminal; and a control electrode of the sixth transistor is connected to the gate line, a first electrode of the sixth transistor is connected to a second low level input terminal, and a second electrode of the sixth transistor is connected to the light-emitting control circuit and the light-emitting device.

For example, the bias-voltage regulating circuit includes an eighth transistor, a control electrode of the eighth transistor is connected to the bias-voltage signal line, a first electrode of the eighth transistor is connected to the first node, and a second electrode of the eighth transistor is connected to the first low level input terminal.

For example, the light-emitting control circuit includes a fourth transistor and a fifth transistor;

a control electrode of the fourth transistor is connected to a third low level input terminal, a first electrode of the fourth transistor is connected to the first power source terminal and the first terminal of the first capacitor, and a second electrode of the fourth transistor is connected to the second electrode of the third transistor and the driving circuit; and a control electrode of the fifth transistor is connected to a fourth level input terminal, a first electrode of the fifth transistor is connected to a second electrode of the sixth transistor and the light-emitting device, and a second electrode of the fifth transistor is connected to the second electrode of the second transistor and the driving circuit.

For example, the driving circuit includes a driving transistor;

a control electrode of the driving transistor is connected to the first node;

a first electrode of the driving transistor is connected to the second electrode of the fourth transistor and the second electrode of the third transistor; and a second electrode of the driving transistor is connected to the second electrode of the fifth transistor and the second electrode of the second transistor.

Embodiments of the disclosure provide a display device, comprising the pixel circuit described above.

Embodiments of the disclosure provide a driving method for the pixel circuit described above, comprising:

at a bias-voltage regulating stage, performing bias voltage regulation on a driving circuit by a bias voltage regulating circuit, to control a pixel unit to be in a bias voltage state;

at a data writing stage, resetting the driving circuit by a reset circuit under control of a reset voltage; and then writing a data voltage into the driving circuit, and meanwhile, resetting the light-emitting device under control of a gate line; and at a light-emitting stage, generating a driving current by the driving circuit according to a control voltage, and outputting the driving current to the light-emitting device by a light-emitting control circuit to drive the light-emitting device to emit light.

For example, the bias-voltage regulating circuit includes an eighth transistor, the driving circuit includes a driving transistor, and the eighth transistor performs bias voltage regulation on the driving transistor under control of a bias-voltage signal line, so as to control the pixel unit to be in the bias voltage state.

For example, the pixel circuit comprises a plurality of pixel units, and before a corresponding data voltage is written into a driving circuit of each of the plurality of pixel units, bias voltage regulation is performed on the driving circuit of each of the plurality of pixel units by the bias-voltage regulating circuit, so as to control each of the plurality of pixel units to be in the same bias voltage state.

BRIEF DESCRIPTION OF THE DRAWINGS

In order to illustrate the technical solutions in the embodiments of the present disclosure or the existing arts more clearly, the drawings needed to be used in the description of the embodiments or the existing arts will be briefly described in the following; it is obvious that the drawings described below are only related to some embodiments of the present disclosure, for one ordinary skilled person in the art, other drawings can be obtained according to these drawings without making other inventive work.

Reference signs: 100—pixel unit; 1—driving circuit; 2—bias-voltage regulating circuit; 3—light-emitting control circuit; 4—light-emitting device; 5—data writing circuit; 6—reset circuit; 61—first reset sub-circuit; and 62—second reset sub-circuit.

DETAILED DESCRIPTION

In order for those skilled in the art to better understand the technical solution of the present disclosure, the present disclosure will be further described in detail in combination with drawings and specific embodiments.

According to a pixel circuit provided by embodiments of the present disclosure, when a pixel unit is in a period of a black frame, a low voltage is input to a reset circuit in the pixel unit; meanwhile, in cooperation with a light-emitting control circuit, a voltage Vgs of the driving circuit is reset, such that the driving circuit is in a bias voltage state. Therefore, regardless of the data voltage of the former stage being in a black frame or in a white frame, the driving circuit starts data writing and compensation under the same bias voltage state, thereby alleviating the problem of short-term afterimage generated by a hysteretic lag effect. The pixel circuit according to the present disclosure is applicable to various OLED display devices.

Figure 1:
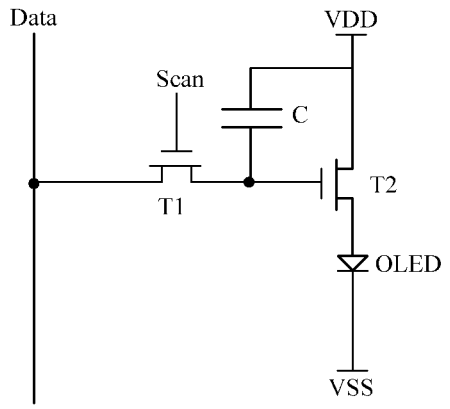
FIG. 1 is a structural schematic diagram of an existing OLED pixel circuit.
Figure 2:
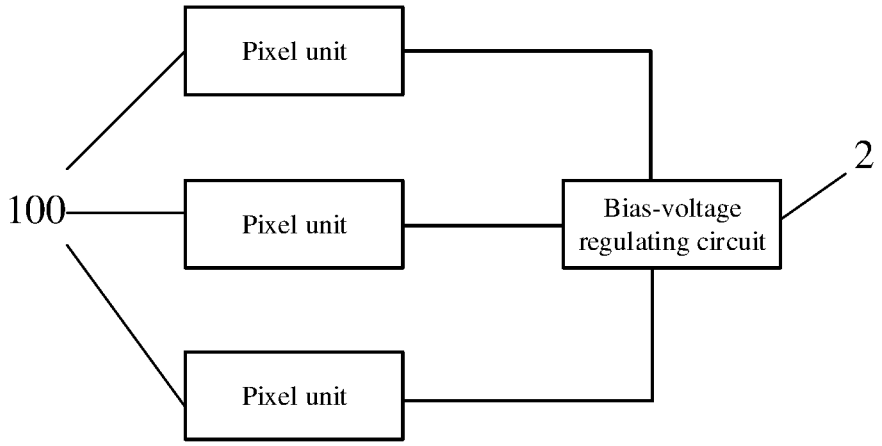
FIGS. 2 and 3 are structural schematic diagrams of a pixel circuit provided by embodiments of the present disclosure.

The pixel circuit provided by embodiments of the present disclosure, as shown in FIG. 2, comprises a plurality of pixel units 100 and a bias-voltage regulating circuit 2. The bias-voltage regulating circuit 2 is configured to perform bias voltage regulation on a driving circuit 1 of each pixel unit 100 before data writing, so as to control each pixel unit 100 to be in the same bias voltage state.

Figure 3:
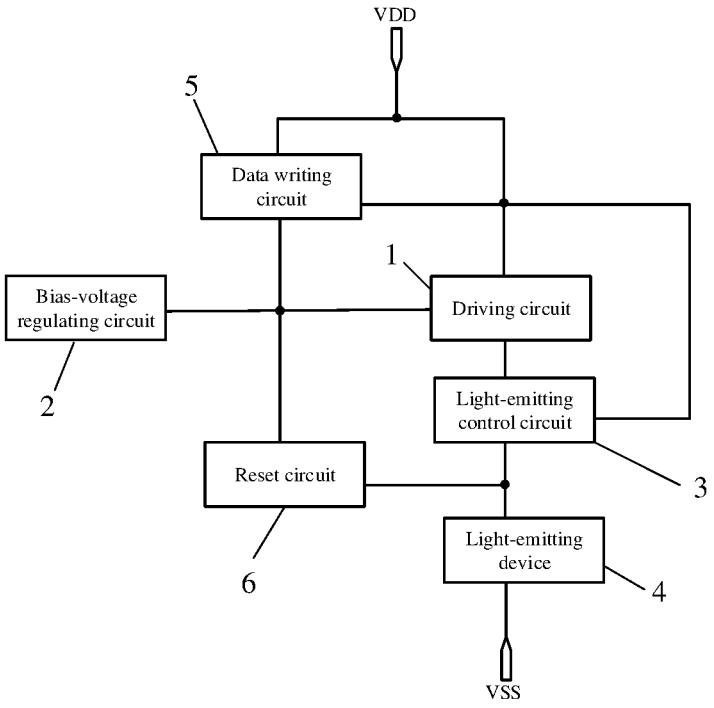

As shown in FIG. 3, each pixel unit 100 includes a driving circuit 1, a light-emitting control circuit 3, a light-emitting device 4, a data writing circuit 5 and a reset circuit 6. The driving circuit 1 is configured to generate a driving current according to a control voltage at a light-emitting stage. The light-emitting control circuit 3 is configured to output the driving current to the light-emitting device 4 at the light-emitting stage, to drive the light-emitting device 4 to emit light. The data writing circuit 5 is configured to write a data voltage and a threshold voltage into the driving circuit 1. The reset circuit 6 is configured to reset the driving circuit 1 under control of a reset voltage, and to reset the light-emitting device 4 under control of a gate line.

For example, the driving circuit 1, the bias-voltage regulating circuit 2, the data writing circuit 5 and the reset circuit 6 are connected to a first node P1. The light-emitting control circuit 3 is connected to a first power source terminal VDD, the driving circuit 1, the light-emitting device 4 and the data writing circuit 5. The light-emitting device 4 is connected to the light-emitting control circuit 3, the reset circuit 6 and a second power source terminal VSS.

In embodiments of the present disclosure, the first power source terminal VDD is configured to provide a working voltage, and the second power source terminal VSS is configured to provide a reference voltage. Usually, a voltage of the first power source terminal VDD is higher and the first power source terminal VDD can be connected to an anode of the light-emitting device, and a voltage of the second power source terminal VSS is lower and the second power source terminal VSS can be connected to a cathode of the light-emitting device.

According to the pixel circuit in embodiments of the present disclosure, when the pixel unit 100 is in the period of a black frame, a gate source voltage (Vgs) of the driving circuit 1 is reset by inputting a low voltage into the reset circuit 6 in the pixel unit 100 in cooperation with the light-emitting control circuit 3, such that the driving circuit 1 is in the bias voltage state. Therefore, no matter the data voltage of the former stage is in a black frame or a white frame, the driving circuit 1 in each pixel unit 100 can start data writing and compensation under the same bias voltage state, thereby alleviating the problem of the short-term afterimage generated by the hysteretic lag effect.

For example, the pixel circuit provided by embodiments of the present disclosure comprises a plurality of pixel units, and the bias-voltage regulating circuit is configured to, before writing a corresponding data voltage into a driving circuit of each of the plurality of pixel units respectively, perform bias voltage regulation on the driving circuit of each of the plurality of pixel units, to control each of the plurality of pixel units to be in the same bias voltage state. In embodiments of the present disclosure, each pixel unit is connected to a corresponding data line Data; and a data voltage provided for the pixel unit by the data line Data is a data voltage corresponding to the pixel unit.

The pixel circuit provided by embodiments of the present disclosure, as shown in FIGS. 2 to 5, similar to the above-described pixel unit, comprises a plurality of pixel units 100 and a bias-voltage regulating circuit 2. The bias-voltage regulating circuit 2 is configured to perform bias voltage regulation on the driving circuit 1 of each pixel unit 100 before data writing, to control each pixel unit 100 to be in the same bias voltage state.

Each pixel unit 100 includes a driving circuit 1, a light-emitting control circuit 3, a light-emitting device 4, a data writing circuit 5 and a reset circuit 6. The driving circuit 1 is configured to generate a driving current according to a control voltage at a light-emitting stage. The light-emitting control circuit 3 is configured to output the driving current to the light-emitting device 4 at the light-emitting stage, so as to drive the light-emitting device 4 to emit light. The data writing circuit 5 is configured to write a data voltage and a threshold voltage into the driving circuit 1. The reset circuit 6 is configured to reset the driving circuit 1 under control of a reset voltage, and to reset the light-emitting device 4 under control of a gate line.

The driving circuit 1, the bias-voltage regulating circuit 2, the data writing circuit 5 and the reset circuit 6 are connected to a first node P1. The light-emitting control circuit 3 is connected to a first power source terminal, the driving circuit 1, the light-emitting device 4 and the data writing circuit 5. The light-emitting device 4 is connected to the light-emitting control circuit 3, the reset circuit 6 and a second power source terminal VSS.

The driving circuit 1 includes a driving transistor T7. The bias-voltage regulating circuit 2 includes an eighth transistor T8. The light-emitting control circuit 3 includes a fourth transistor T4 and a fifth transistor T5. The data writing circuit 5 includes a first capacitor C1, a second transistor T2 and a third transistor T3. The reset circuit 6 includes a first reset sub-circuit 61 and a second reset sub-circuit 62. The first reset sub-circuit 61 includes a first transistor T1, and the second reset sub-circuit 62 includes a sixth transistor T6. It should be noted that the light-emitting device 4 in embodiments of the present disclosure may be a current-driven light-emitting device 4 including a Light Emitting Diode (LED) or an Organic Light Emitting Diode (OLED). The OLED is taken as an example for description in embodiments of the present disclosure.

Figure 4:
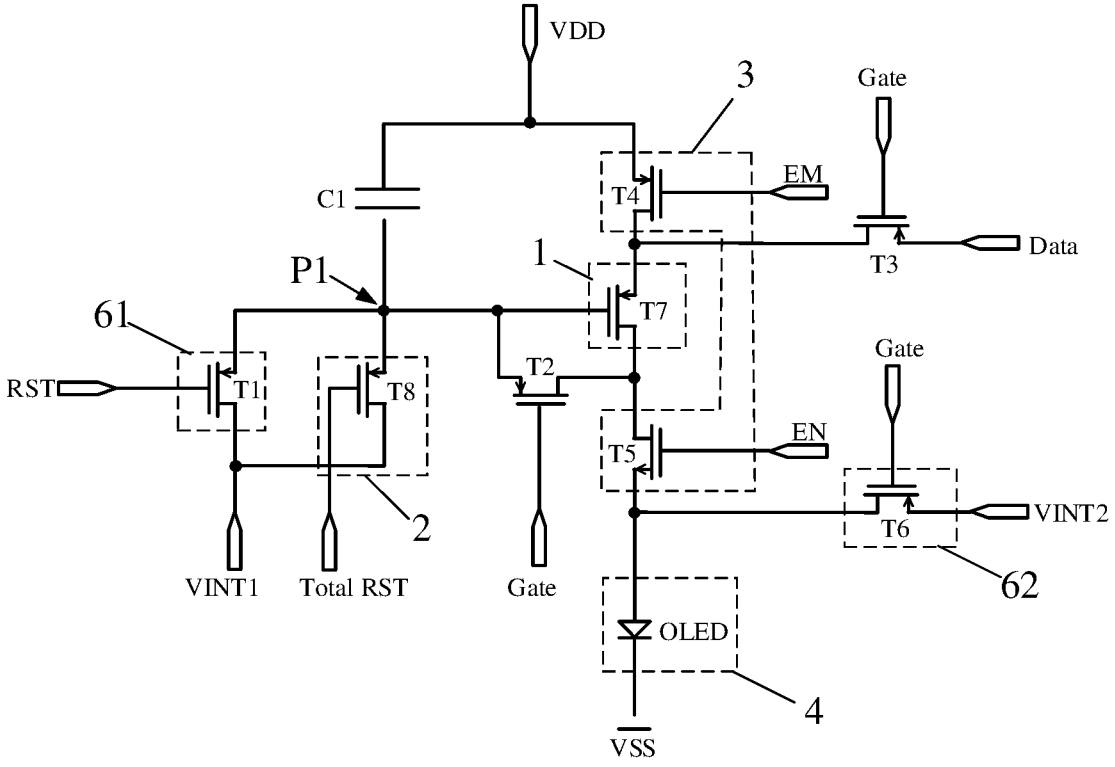
FIGS. 4 to 7 are structural schematic diagrams of a pixel circuit provided by embodiments of the present disclosure.
Figure 5:
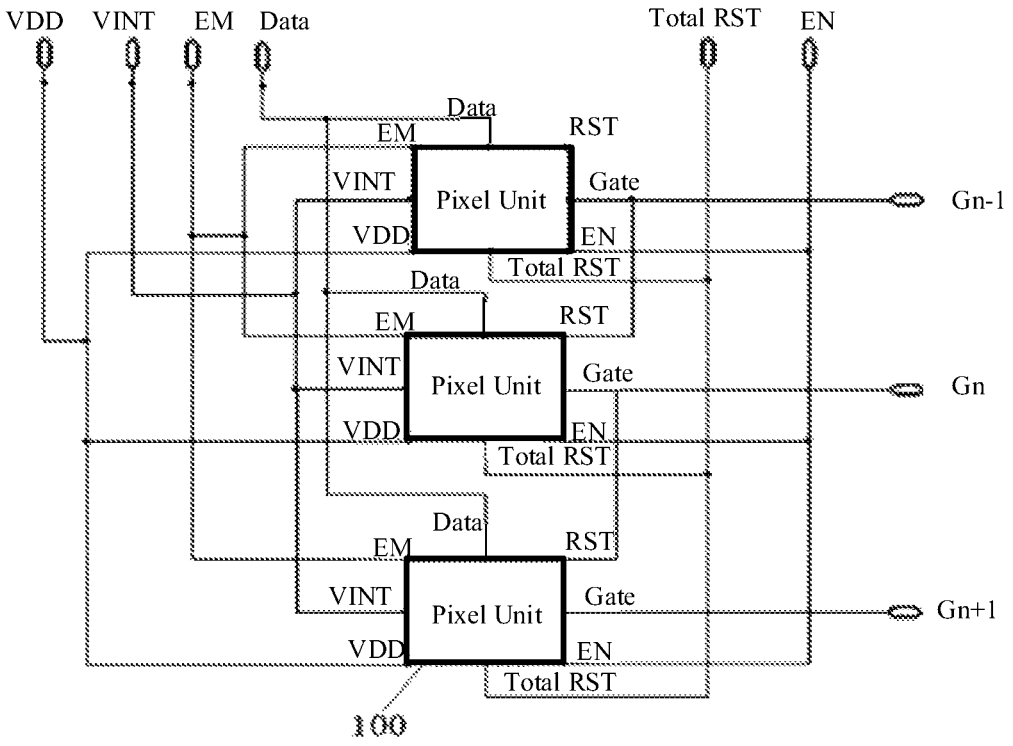

In a first implementation in embodiments of the present disclosure, as shown in FIGS. 4 and 5, the fifth transistor T5 is an N-type transistor, and the fourth transistor T4 is a P-type transistor. When a high-level voltage is input by a fourth level input terminal EN, the transistor T5 is turned on. In addition, the first transistor T1, the second transistor T2, the third transistor T3, the sixth transistor T6, the driving transistor T7 and the eighth transistor T8 are all P-type transistors.

For example, a control electrode of the fourth transistor T4 is connected to a third level input terminal EM (when a low-level voltage is input by the third level input terminal EM, the transistor T4 is turned on). A first electrode of the fourth transistor T4 is connected to the first power source terminal VDD and a first terminal of the first capacitor C1. A second electrode of the fourth transistor T4 is connected to a second electrode of the third transistor T3 and a first electrode of the driving transistor T7. A control electrode of the fifth transistor T5 is connected to the fourth level input terminal EN, a first electrode of the fifth transistor T5 is connected to a second electrode of the sixth transistor T6 and the light-emitting device 4, and a second electrode of the fifth transistor T5 is connected to a second electrode of the second transistor T2 and a second electrode of the driving transistor T7.

For example, a control electrode of the eighth transistor T8 is connected to a bias-voltage signal line Total RST, a first electrode of the eighth transistor T8 is connected to the first node P1, and a second electrode of the eighth transistor T8 is connected to a first low level input terminal VINT1.

As shown in FIG. 2, the bias-voltage regulating circuit 2 is connected to a plurality of pixel units 100 respectively. In combination with FIG. 4, each pixel unit 100 may include one eighth transistor T8, which serves as part of the bias-voltage regulating circuit 2. Of course, different pixel units 100 may also share an eighth transistor T8, where the first electrode of the eighth transistor T8 is connected to the first node P1 in each pixel unit 100, and the second electrode of the eighth transistor T8 is connected to the first low level input terminal VINT1. The present disclosure is not limited thereto.

For example, a control electrode of the driving transistor T7 is connected to the first node P1. The first electrode of the driving transistor T7 is connected to the second electrode of the fourth transistor T4 and the second electrode of the third transistor T3. The second electrode of the seventh transistor T7 is connected to the second electrode of the fifth transistor T5 and the second electrode of the second transistor T2.

For example, the first terminal of the first capacitor C1 is connected to the first power source terminal VDD and the first electrode of the fourth transistor T4, and a second terminal of the first capacitor C1 is connected to the first node P1. A control electrode of the second transistor T2 is connected to a gate line Gate, a first electrode of the second transistor T2 is connected to the first node P1, and the second electrode of the second transistor T2 is connected to the second electrode of the fifth transistor T5 and the second electrode of the driving transistor T7. A control electrode of the third transistor T3 is connected to the gate line Gate, a first electrode of the third transistor T3 is connected to the data line Data, and a second electrode of the third transistor T3 is connected to the second electrode of the fourth transistor T4 and the first electrode of the driving transistor T7.

For example, the control electrode of the first transistor T1 is connected to a reset-voltage signal line RST, a first electrode of the first transistor T1 is connected to the first node P1, and a second electrode of the first transistor T1 is connected to the first low level input terminal VINT1. A control electrode of the sixth transistor T6 is connected to the gate line Gate, a first electrode of the sixth transistor T6 is connected to a second low level input terminal VINT2, and a second electrode of the sixth transistor T6 is connected to the first electrode of the fifth transistor and the light-emitting device 4. For example, the first transistor T1 is configured to reset the driving transistor T7 (for example, to reset the control electrode of the driving transistor T7) under control of a reset voltage input by the reset-voltage signal line RST. The sixth transistor T6 is configured to reset the light-emitting device 4 under control of the gate line Gate (for example, to reset the anode of the light-emitting device 4).

For example, the first low level input terminal VINT1 and the second low level input terminal VINT2 may be connected to the same low level input terminal VINT as shown in FIG. 5.

Figure 6:
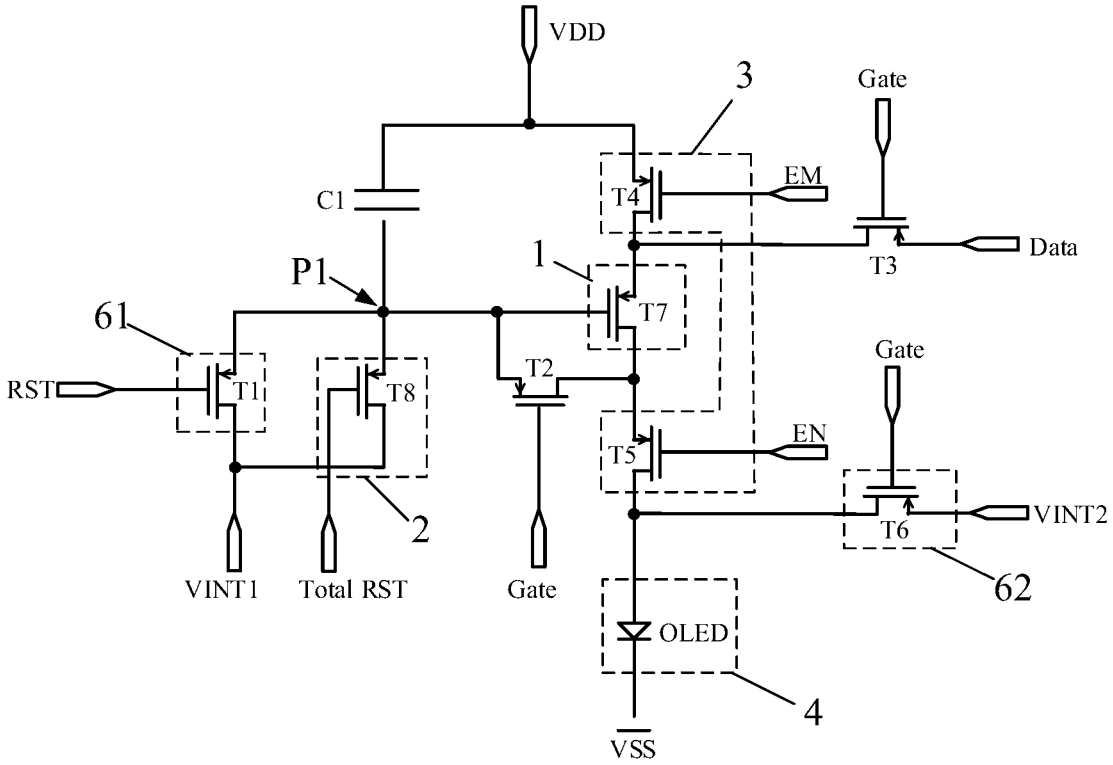

In a second implementation in embodiments of the present disclosure, as shown in FIG. 6, the fifth transistor T5 and the fourth transistor T4 are both P-type transistors. When a low-level voltage is input by the fourth level input terminal EN, the fifth transistor T5 is turned on. In addition, the first transistor T1, the second transistor T2, the third transistor T3, the sixth transistor T6, the driving transistor T7 and the eighth transistor T8 are all P-type transistors.

For example, a control electrode of the fourth transistor T4 is connected to the third level input terminal EM. A first electrode of the fourth transistor T4 is connected to the first power source terminal VDD and a first terminal of the first capacitor C1. A second electrode of the fourth transistor T4 is connected to a second electrode of the third transistor T3 and a first electrode of the driving transistor T7. A control electrode of the fifth transistor T5 is connected to a fourth level input terminal EN, a first electrode of the fifth transistor T5 is connected to a second electrode of the second transistor T2 and a second electrode of the driving transistor, and a second electrode of the fifth transistor T5 is connected to a second electrode of the sixth transistor T6 and the light-emitting device 4.

For example, a control electrode of the eighth transistor T8 is connected to a bias-voltage signal line Total RST, a first electrode of the eighth transistor T8 is connected to the first node P1, and a second electrode of the eighth transistor T8 is connected to a first low level input terminal VINT1.

For example, a control electrode of the driving transistor T7 is connected to the first node P1. The first electrode of the driving transistor T7 is connected to the second electrode of the fourth transistor T4 and the second electrode of the third transistor T3. A second electrode of the driving transistor transistor T7 is connected to the first electrode of the fifth transistor T5 and the second electrode of the second transistor T2.

For example, the first terminal of the first capacitor C1 is connected to the first power source terminal VDD and the first electrode of the fourth transistor T4, and a second terminal of the first capacitor C1 is connected to the first node P1. A control electrode of the second transistor T2 is connected to a gate line Gate, a first electrode of the second transistor T2 is connected to the first node P1, and the second electrode of the second transistor T2 is connected to the first electrode of the fifth transistor T5 and the second electrode of the driving transistor T7. A control electrode of the third transistor T3 is connected to the gate line Gate, a first electrode of the third transistor T3 is connected to the data line Data, and the second electrode of the third transistor T3 is connected to the second electrode of the fourth transistor T4 and the first electrode of the driving transistor T7.

For example, the control electrode of the first transistor T1 is connected to a reset-voltage signal line RST, a first electrode of the first transistor T1 is connected to the first node P1, and a second electrode of the first transistor T1 is connected to the first low level input terminal VINT1. A control electrode of the sixth transistor T6 is connected to the gate line Gate, a first electrode of the sixth transistor T6 is connected to a second low level input terminal VINT2, and a second electrode of the sixth transistor T6 is connected to the second electrode of the fifth transistor and the light-emitting device 4. For example, the first transistor T1 is configured to reset the driving transistor T7 under control of a reset voltage input by the reset-voltage signal line RST. The sixth transistor T6 is configured to reset the light-emitting device 4 under control of the gate line Gate.

Figure 7:
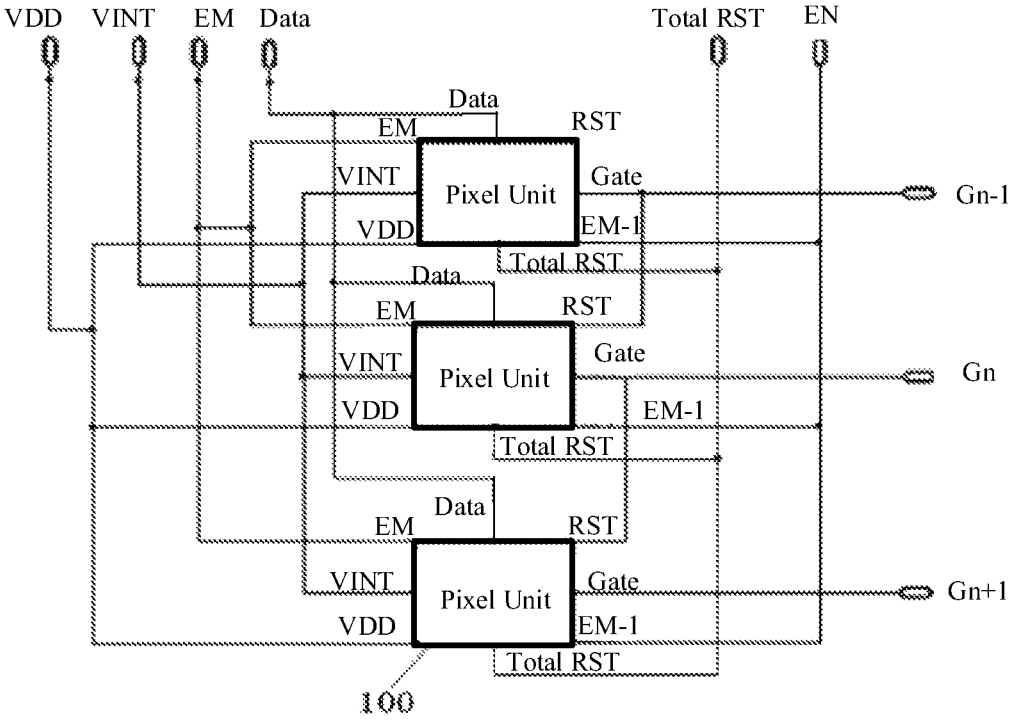

For example, the first low level input terminal VINT1 and the second low level input terminal VINT2 may be connected to the same low level input terminal VINT as shown in FIG. 7.

It should be noted that in embodiments of the present disclosure, the first transistor T1, the second transistor T2, the third transistor T3, the fourth transistor T4, the fifth transistor T5, the sixth transistor T6, the driving transistor T7 and the eighth transistor T8 are respectively selected from one of a polycrystalline silicon thin film transistor, an amorphous silicon thin film transistor, an oxide thin film transistor and an organic thin film transistor independently. Each transistor includes three electrodes of a gate electrode, a source electrode and a drain electrode, where the gate electrode is the control electrode, and the source electrode and the drain electrode are usually defined by a current direction and are not different in structure. Therefore, the first electrode and the second electrode in the embodiments of the present disclosure respectively refer to the source electrode and the drain electrode of the transistor; alternatively, the first electrode and the second electrode in the embodiments of the present disclosure respectively refer to the drain electrode and the source electrode of the transistor. The disclosure is not limited thereto.

Figure 8:
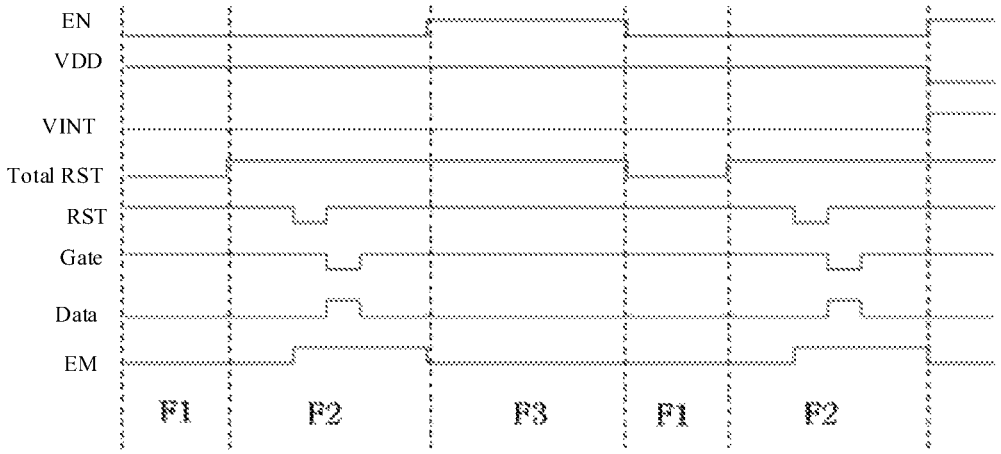
FIG. 8 is a timing sequence diagram of a driving method for a pixel circuit provided by an embodiment of the present disclosure.

An embodiment of the present disclosure provides a driving method for a pixel circuit, and adopts the structure of the pixel circuit of the above FIG. 4. As shown in FIG. 8, the method comprises:

Step S01: at a bias-voltage regulating stage F1, performing bias voltage regulation on a driving circuit in each pixel unit by a bias-voltage regulating circuit, so as to control each pixel unit to be in the same bias voltage state.

Figure 9:
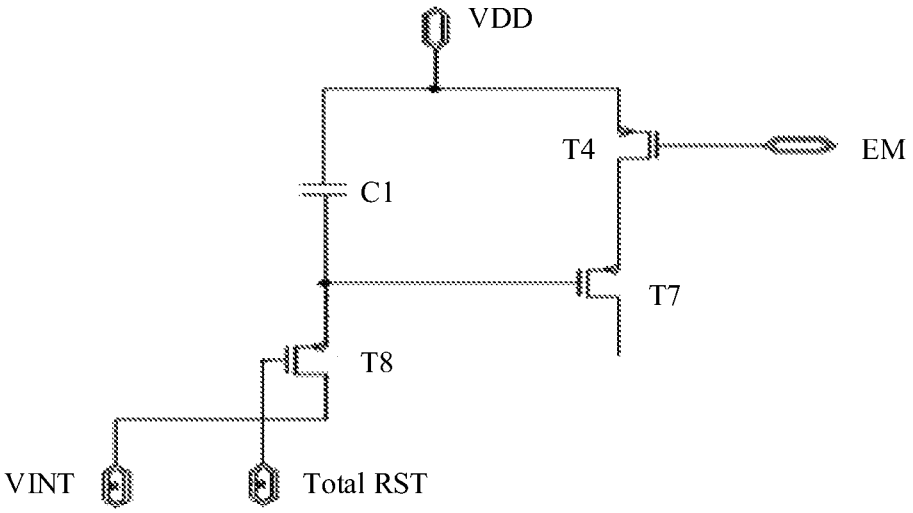
FIGS. 9 to 12 are schematic diagrams of equivalent circuits corresponding to a driving method for the pixel circuit of FIG. 3.

Referring to FIGS. 4 and 5, when a low-level voltage is output by the bias-voltage signal line Total RST, the eighth transistor T8 connected to the bias-voltage signal line Total RST is tuned on; at this point, a voltage of the first low level input terminal VINT1 is input to the control electrode of the driving transistor T7. Meanwhile, a low-level voltage is input by the third level input terminal EM, the fourth transistor T4 is turned on, and a voltage of the first power source terminal VDD flows into the first electrode of the driving transistor T7. Therefore, it ensures that the driving transistor T7 is in the same bias voltage state (Vgs=VINT−VDD), and the driving transistor T7 performs data writing and Vth compensation under the same bias voltage state, such that the state of the driving transistor T7 is the same. Therefore, the objective of alleviating the short-term after-image can be achieved. At this point, part of the equivalent circuit diagram is as shown in FIG. 9.

Step S02: at a data writing stage F2, under control of a reset voltage, resetting the driving circuit by a reset circuit; and then writing a data voltage into the driving circuit by a data writing circuit, and meanwhile, resetting the light-emitting device under control of a gate line.

Figure 10:
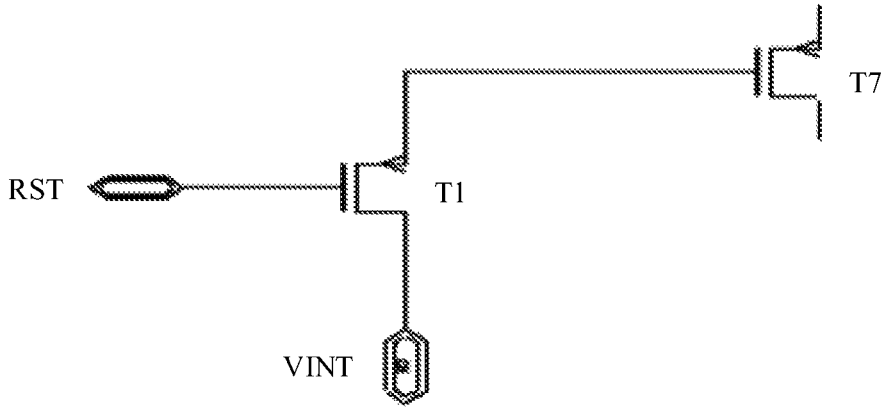

When a low-level voltage is output by the reset-voltage signal line RST, the first transistor T1 is turned on; at this point, the first low level input terminal VINT1 resets the control electrode of the driving transistor T7 through the first transistor T1, and charges the first capacitor C1; and at this point, a gate electrode voltage Vgate of the driving transistor T7 is equal to VINT1. At this point, part of the equivalent circuit diagram is as shown in FIG. 10.

Figure 11:
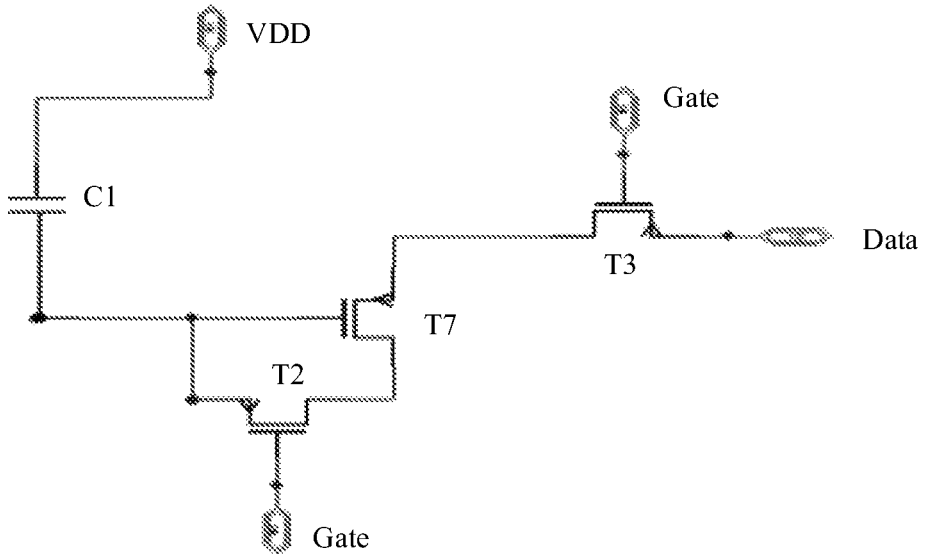

When a low-level voltage is input by the gate line Gate, the third transistor T3, the driving transistor T7 and the second transistor T2 are turned on, the control electrode of the driving transistor T7 is continuously to be charged by the first capacitor C1 until the control electrode of the driving transistor T7 reaches a voltage of VDATA−Vth. The VDATA is a data voltage. When a gate-source voltage VGS of the P-type transistor is smaller than Vth, the transistor is turned on. At this point, the Vgate of the control electrode of the driving transistor T7 is equal to VDATA−Vth. Meanwhile, an OLED anode is reset by the sixth transistor T6, and a low-level voltage is input by the second low level input terminal VINT2 to protect the device. At this point, part of the equivalent circuit diagram is as shown in FIG. 11.

Step S03: at a light-emitting stage F3, generating a driving current by the driving circuit according to a control voltage, and outputting the driving current to the light-emitting device by a light-emitting control circuit, so as to drive the light-emitting device to emit light.

Figure 12:
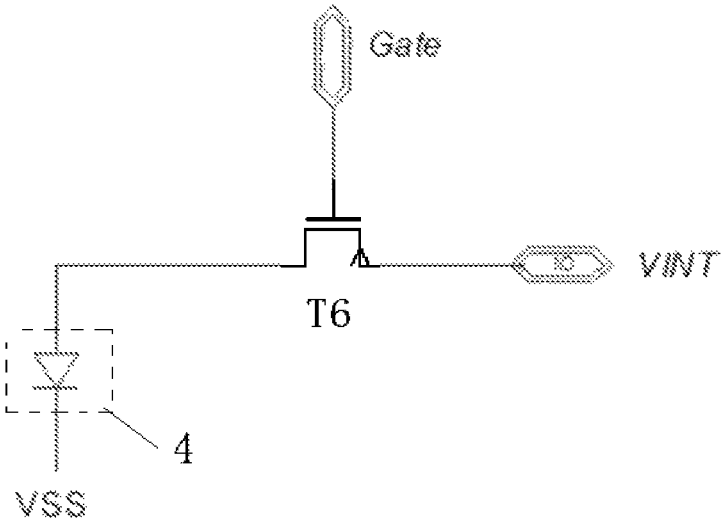

When a low-level voltage is output by the third level input terminal EM, and a high-level voltage is input by the fourth level input terminal EN, the fourth transistor T4 and the fifth transistor T5 are turned on; at this point, the Vgs of the driving transistor T7 meets Vgs=VDATA−Vth−VDD<Vth, the driving transistor T7 is turned on, the circuit enters a light emitting state, and the OLED starts to emit light; and at this point, a current IS flowing through the OLED device meets IS=1/2UnCox(W/L)(VGS−Vth)^2=1/2UnCox(W/L)(VDATA−|Vth|−ELVDD−(−|Vth|))^2=1/2UnCox(W/L)(ELVDD−VDATA)^2. At this point, a stable current flows through the OLED device, and the light emission of the device is stable. At this point, part of the equivalent circuit diagram is as shown in FIG. 12.

A driving method for a pixel circuit provided by embodiments of the present disclosure adopts the pixel circuit as shown in FIG. 6. The method is similar to the above method, and differs from the above method in the following:

Step S03: at the light-emitting stage F3, when a low-level voltage is output by the third level input terminal EM, a low-level voltage is also input by the fourth level input terminal EN; and at this point, the fourth transistor T4 and the fifth transistor T5 are turned on.

An embodiment of the present disclosure provides a display device, comprising the pixel circuit of the above embodiments.

The display device may be any product or component having a display function, such as an electronic paper, an OLED panel, a mobile phone, a tablet computer, a television, a display, a laptop, a digital photo frame and a navigator.

In the present disclosure, terms such as "first", "second" and the like used in the present disclosure do not indicate any sequence, quantity or significance but only for distinguishing different constituent parts. Also, the terms such as "a," "an," or "the" etc., are not intended to limit the amount, but indicate the existence of at least one. The terms "comprises," "comprising," "includes," "including," etc., are intended to specify that the elements or the objects stated before these terms and encompass the elements or the objects and equivalents thereof listed after these terms, but do not preclude the other elements or objects.

It is understandable that the above embodiments are merely exemplary embodiments adopted to explain the principle of the present disclosure; however, the present disclosure is not limited thereto. For those ordinarily skilled in the art, various transformations and improvements can be made without departing the spirit and essence of the present disclosure, and these transformations and improvements are also within the protection scope of the present disclosure.

What are described above is related to the illustrative embodiments of the disclosure only and not limitative to the scope of the disclosure; any changes or replacements easily for those technical personnel who are familiar with this technology in the field to envisage in the scopes of the disclosure, should be in the scope of protection of the present disclosure. Therefore, the scopes of the disclosure are defined by the accompanying claims.

The invention claimed is:

1. A pixel circuit, comprising a pixel unit and a bias-voltage regulating circuit, wherein:

the pixel unit includes a light-emitting device, a driving circuit, a light-emitting control circuit, a data writing circuit and a reset circuit;

the driving circuit is configured to generate a driving current according to a control voltage at a light-emitting stage;

the light-emitting control circuit is configured to output the driving current to the light-emitting device at the light-emitting stage, to drive the light-emitting device to emit light;

the data writing circuit is configured to write a data voltage into the driving circuit;

the reset circuit is configured to reset the driving circuit under control of a reset voltage, and to reset the light-emitting device under control of a gate line; and the bias-voltage regulating circuit is configured to, before the data writing circuit writes the data voltage into the driving circuit, perform bias voltage regulation on the driving circuit to control the pixel unit to be in a bias voltage state, the reset circuit includes a first reset sub-circuit and a second reset sub-circuit;

the first reset sub-circuit is configured to reset the driving circuit under control of the reset voltage; and the second reset sub-circuit is configured to reset the light-emitting device under control of the gate line, an input end of the bias-voltage regulating circuit is electrically connected to an input end of the first reset sub-circuit, an output end of the bias-voltage regulating circuit is electrically connected to an output end of the first reset sub-circuit.

2. The pixel circuit according to claim 1, wherein the pixel circuit comprises a plurality of pixel units, and the bias-voltage regulating circuit is configured to, before a corresponding data voltage is written into a driving circuit of each of the plurality of pixel units respectively, perform bias voltage regulation on the driving circuit of each of the plurality of pixel units, so as to control each of the plurality of pixel units to be in the same bias voltage state.

3. The pixel circuit according to claim 2, wherein the data writing circuit includes a first capacitor, a second transistor and a third transistor;

a first terminal of the first capacitor is connected to the first power source terminal and the light-emitting control circuit, and a second terminal of the first capacitor is connected to a first node;

a control electrode of the second transistor is connected to the gate line, a first electrode of the second transistor is connected to the first node, and a second electrode of the second transistor is connected to the light-emitting control circuit and the driving circuit; and a control electrode of the third transistor is connected to the gate line, a first electrode of the third transistor is connected to a data line, and a second electrode of the third transistor is connected to the light-emitting control circuit and the driving circuit.

4. The pixel circuit according to claim 3, wherein the first reset sub-circuit includes a first transistor, and the second reset sub-circuit includes a sixth transistor; the output end of the first reset sub-circuit comprises a first electrode of the first transistor, the input end of the first reset sub-circuit comprises a second electrode of the first transistor, the first electrode of the first transistor is connected to the first node, a control electrode of the first transistor is connected to a reset-voltage signal line, and the second electrode of the first transistor is connected to a first low level input terminal; and a control electrode of the sixth transistor is connected to the gate line, a first electrode of the sixth transistor is connected to a second low level input terminal, and a second electrode of the sixth transistor is connected to the light-emitting control circuit and the light-emitting device.

5. The pixel circuit according to claim 4, wherein the bias-voltage regulating circuit includes an eighth transistor, the output end of the bias-voltage regulating circuit comprises a first electrode of the eighth transistor, and the input end of the bias-voltage regulating circuit comprises a second electrode of the eighth transistor, a control electrode of the eighth transistor is connected to the bias-voltage signal line, the first electrode of the eighth transistor is connected to the first node, and the second electrode of the eighth transistor is connected to the first low level input terminal.

6. The pixel circuit according to claim 4, wherein the light-emitting control circuit includes a fourth transistor and a fifth transistor;

a control electrode of the fourth transistor is connected to a third low level input terminal, a first electrode of the fourth transistor is connected to the first power source terminal and the first terminal of the first capacitor, and a second electrode of the fourth transistor is connected to the second electrode of the third transistor and the driving circuit; and a control electrode of the fifth transistor is connected to a fourth level input terminal, a first electrode of the fifth transistor is connected to a second electrode of the sixth transistor and the light-emitting device, and a second electrode of the fifth transistor is connected to the second electrode of the second transistor and the driving circuit.

7. The pixel circuit according to claim 3, wherein the driving circuit includes a driving transistor;

a control electrode of the driving transistor is connected to the first node;

a first electrode of the driving transistor is connected to the second electrode of the fourth transistor and the second electrode of the third transistor; and a second electrode of the driving transistor is connected to the second electrode of the fifth transistor and the second electrode of the second transistor.

8. The pixel circuit according to claim 2, wherein the output end of the bias-voltage regulating circuit is electrically connected to a control end of the driving circuit.

9. The pixel circuit according to claim 1, wherein the data writing circuit includes a first capacitor, a second transistor and a third transistor;

a first terminal of the first capacitor is connected to a first power source terminal and the light-emitting control circuit, and a second terminal of the first capacitor is connected to a first node;

a control electrode of the second transistor is connected to the gate line, a first electrode of the second transistor is connected to the first node, and a second electrode of the second transistor is connected to the light-emitting control circuit and the driving circuit; and a control electrode of the third transistor is connected to the gate line, a first electrode of the third transistor is connected to a data line, and a second electrode of the third transistor is connected to the light-emitting control circuit and the driving circuit.

10. The pixel circuit according to claim 9, wherein the first reset sub-circuit includes a first transistor, and the second reset sub-circuit includes a sixth transistor; the output end of the first reset sub-circuit comprises a first electrode of the first transistor, the input end of the first reset sub-circuit comprises a second electrode of the first transistor, the first electrode of the first transistor is connected to the first node, a control electrode of the first transistor is connected to a reset-voltage signal line, and the second electrode of the first transistor is connected to a first low level input terminal; and a control electrode of the sixth transistor is connected to the gate line, a first electrode of the sixth transistor is connected to a second low level input terminal, and a second electrode of the sixth transistor is connected to the light-emitting control circuit and the light-emitting device.

11. The pixel circuit according to claim 10, wherein the bias-voltage regulating circuit includes an eighth transistor, the output end of the bias-volume regulating circuit comprises a first electrode of the eighth transistor, and the input end of the bias-voltage regulating circuit comprises a second electrode of the eighth transistor, a control electrode of the eighth transistor is connected to a bias-voltage signal line, the first electrode of the eighth transistor is connected to the first node, and the second electrode of the eighth transistor is connected to the first low level input terminal.

12. The pixel circuit according to claim 10, wherein the light-emitting control circuit includes a fourth transistor and a fifth transistor;

a control electrode of the fourth transistor is connected to a third low level input terminal, a first electrode of the fourth transistor is connected to the first power source terminal and the first terminal of the first capacitor, and a second electrode of the fourth transistor is connected to the second electrode of the third transistor and the driving circuit; and a control electrode of the fifth transistor is connected to a fourth level input terminal, a first electrode of the fifth transistor is connected to a second electrode of the sixth transistor and the light-emitting device, and a second electrode of the fifth transistor is connected to the second electrode of the second transistor and the driving circuit.

13. The pixel circuit according to claim 12, wherein the fifth transistor is an N-type transistor and the fourth transistor is a P-type transistor.

14. The pixel circuit according to claim 12, wherein the fifth transistor and the fourth transistor are both P-type transistors.

15. The pixel circuit according to claim 12, wherein the driving circuit includes a driving transistor;

a control electrode of the driving transistor is connected to the first node;

a first electrode of the driving transistor is connected to the second electrode of the fourth transistor and the second electrode of the third transistor; and a second electrode of the driving transistor is connected to the second electrode of the fifth transistor and the second electrode of the second transistor.

16. A display device, comprising the pixel circuit according to claim 1.

17. A driving method for the pixel circuit according to claim 1, comprising:

at a bias-voltage regulating stage, performing bias voltage regulation on a driving circuit by a bias voltage regulating circuit, to control a pixel unit to be in a bias voltage state;

at a data writing stage, resetting the driving circuit by a reset circuit under control of a reset voltage; and then writing a data voltage into the driving circuit, and meanwhile, resetting the light-emitting device under control of a gate line; and at a light-emitting stage, generating a driving current by the driving circuit according to a control voltage, and outputting the driving current to the light-emitting device by a light-emitting control circuit to drive the light-emitting device to emit light.

18. The driving method according to claim 17, wherein the bias-voltage regulating circuit includes an eighth transistor, the driving circuit includes a driving transistor, and the eighth transistor performs bias voltage regulation on the driving transistor under control of a bias-voltage signal line, so as to control the pixel unit to be in the bias voltage state.

19. The driving method according to claim 17, wherein the pixel circuit comprises a plurality of pixel units, and before a corresponding data voltage is written into a driving circuit of each of the plurality of pixel units, bias voltage regulation is performed on the driving circuit of each of the plurality of pixel units by the bias-voltage regulating circuit, so as to control each of the plurality of pixel units to be in the same bias voltage state.

20. The pixel circuit according to claim 1, wherein the output end of the bias-voltage regulating circuit is electrically connected to a control end of the driving circuit.

* * * * *